United States Patent [19]

Daly

[11] 4,052,075

[45] Oct. 4, 1977

[54] GOLF CLUB

[76] Inventor: C. Robert Daly, Rte. No. 1, 75 Pasco Road, Zephyrhills, Fla. 33599

[21] Appl. No.: 647,408

[22] Filed: Jan. 8, 1976

[51] Int. Cl.[2] ..... A63B 53/08

[52] U.S. Cl. ..... 273/171

[58] Field of Search ..... 273/77 R, 167–172, 273/73 J

[56] References Cited

U.S. PATENT DOCUMENTS

| | | | |
|---|---|---|---|
| 1,518,316 | 12/1924 | Ellingham | 273/171 |
| 1,524,488 | 1/1925 | Read | 273/169 |
| 2,163,091 | 6/1939 | Held | 273/171 |
| 3,606,327 | 9/1971 | Gorman | 273/171 X |
| 3,743,297 | 7/1973 | Dennis | 273/171 X |
| 3,759,527 | 9/1973 | Witherspoon | 273/171 |

FOREIGN PATENT DOCUMENTS

| | | | |
|---|---|---|---|
| 8,954 of | 1893 | United Kingdom | 273/171 |
| 174,550 | 2/1922 | United Kingdom | 273/73 J |
| 194,823 | 3/1923 | United Kingdom | 273/171 |
| 218,423 | 7/1924 | United Kingdom | 273/73 J |
| 346,671 | 4/1931 | United Kingdom | 273/171 |

*Primary Examiner*—Richard J. Apley
*Attorney, Agent, or Firm*—Shlesinger, Arkwright, Garvey & Dinsmore

[57] ABSTRACT

A golf club having an adjustable and removable weight insert positioned in the club head. The insert includes a tubular sleeve which is fixedly positioned in a complemental bore in the club head, the weight insert being substantially perpendicular to the sole plate of the golf club. The weight insert is positioned behind, and centrally of, the ball-engaging portion of the club's striking face and aligned with the plane of the club shaft. The insert further includes a screw member which is threaded into the tubular sleeve, on the shank portion of which a plurality of weight discs are removably positioned. A retaining member holds the discs in position and a sealing member is interposed between the head of the screw member and the tubular sleeve.

2 Claims, 5 Drawing Figures

GOLF CLUB

BACKGROUND OF THE INVENTION

In the manufacture of golf clubs and particularly woods, it is standard practice to custom fit the club for the individual golfer. This is effected by employing different materials, using a variety of sizes of club heads and making the club shaft of different lengths. One important factor in custom fitting the golf club for the user is to weight the club head to suit the individual preference of the golfer.

In the past, various means have been devised for altering the weight of the club, such as by drilling a hole or holes in the club head and pouring lead or other heavy substance therein. Other weight means of a removable nature have also been devised which permits variations in the weight applied to a golf club, thereby enabling the golfer to change the amount of weight, when desired. Illustrative of such variable weighting arrangements are those disclosed in U.S. Pat. Nos. 1,518,316, 1,540,559, 1,575,364, 1,840,924, 3,606,327 and 3,652,094. With all of these arrangements for weighting the golf club, however, the addition or removal of the weights adversely affects the control and balance of the golf club.

SUMMARY OF THE INVENTION

The present invention is a variable and removable weight insert which is positioned in the head of a standard golf club and is strategically positioned therein to effect improved swing control and club balance. In accordance with the present invention, a weight insert is passed through an opening in the sole plate of the golf club into a bore within the club head which is so located that the weight insert lies behind the "sweet spot" of the club face directly in line with the shaft and grain of the block on which the club is made. The weight insert further lies in the thick part of the club head, thereby allowing greater flexibility in the number of weights comprising the insert and lending greater structural stability to the club.

The location of the insert centrally of the ball-engaging portion of the club's striking face creates a zero moment of force with the swing plane axis at impact and the center of gravity of the swing weight is directly centered in the hitting area of the club.

The weight insert is of simple construction, including a tubular sleeve fixedly positioned in a bore within the club head, and a screw member having a selected number of weight discs mounted therein is threadly engaged with the tubular sleeve. A retaining member holds the weights in position and a sealing member between the head of the screw member and the tubular sleeve prevents moisture and foreign materials from entering the sleeve and also facilitates engagement and disengagement of the screw member and the tubular sleeve.

DETAILED DESCRIPTION OF THE INVENTION

Figure 1:
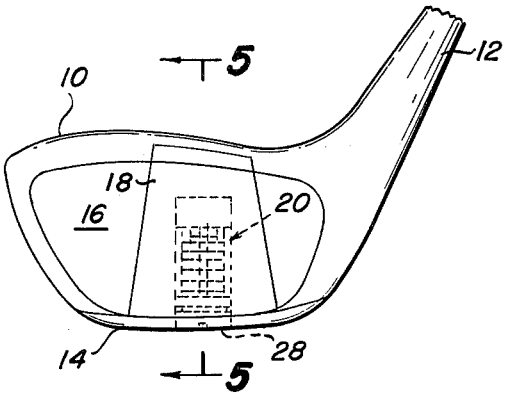
FIG. 1 is a fragmentary front elevational view of a golf club constructed in accordance with the present invention.

The golf club of the present invention includes a club head 10 preferably of wood construction having a hollow shank portion 12 extending upwardly therefrom and adapted to receive a shaft (not shown). The golf club further includes a sole plate 14 on the bottom face thereof and a striking face 16 having an epoxy insert 18 which is adapted to engage the golf ball. In accordance with the present invention, there is provided a cylindrical bore 20 which extends through sole plate 14 and extends substantially perpendicular to the club head behind striking face 16 and centrally of ball engaging epoxy insert 18, as shown to advantage in FIG. 1.

Figure 2:
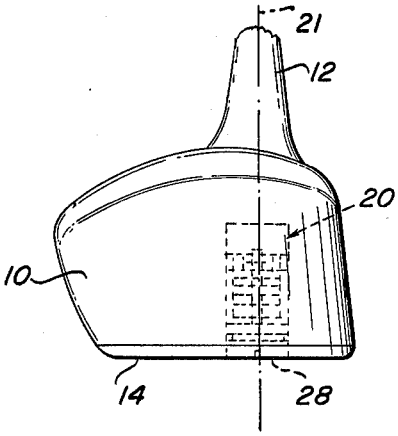
FIG. 2 is an end elevational view of the golf club of the present invention.
Figure 3:
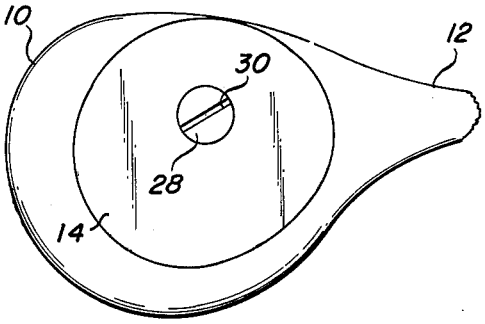
FIG. 3 is a bottom plan view of the golf club of the present invention.

Referring now to FIG. 2, it will be seen that bore 20 is directly in line with the longitudinal axis 20% hollow shank portion 12 and the shaft extending therefrom, and is also aligned with the grain of the wood block from which the club is made.

Figure 4:
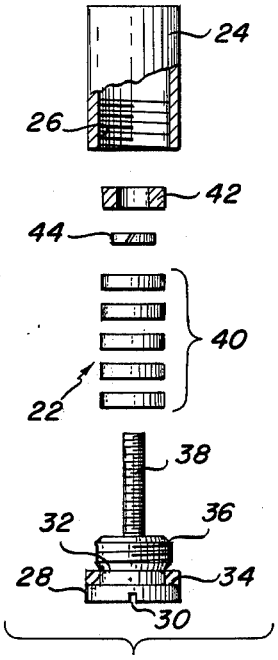
FIG. 4 is an exploded plan view of the weight insert of the present invention.
Figure 5:
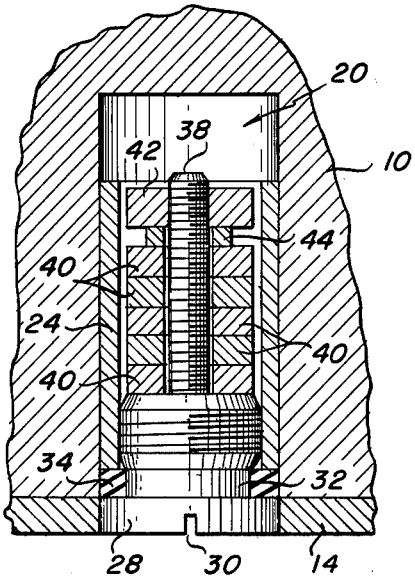
FIG. 5 is an enlarged sectional view taken along the line 5—5 of FIG. 1, looking in the direction of the arrows.

In accordance with the present invention, bore 20 is adapted for the reception of weight insert generally designated 22 which is shown to advantage in FIGS. 4 and 5. Weight insert 22 includes a tubular sleeve 24, one end of which is internally threaded at 26. Sleeve 24 is adapted to be fixedly positioned within bore 20 by an adhesive or any other suitable means.

Weight insert 22 further includes a screw member comprising a head 28 having a kerf 30 beneath which is a non-threaded shoulder portion 32 around which is positioned an O-ring or other suitable sealing member 34. Shoulder portion 32 issues into a threaded portion 36 adapted for engagement with complemental threads 26 of tubular sleeve 24. A threaded shaft 38 of substantially reduced cross-sectional area extends centrally from threaded portion 36 on which threaded shaft are a plurality of weight discs 40 made of brass or other suitable heavy material. Discs 40 are provided with a central opening to permit the disc to be slipped over threaded shaft 38. A retaining member or nut 42 is threadedly engaged with threaded shaft 38 and a lock washer 44 is interposed between nut 42 and the adjacent discs 40 to prevent accidental disengagement of the nut from shaft 38.

It will be apparent from a consideration of the drawings that in use of the weight insert of the present invention, a predetermined number of weight discs 40 are placed over threaded shaft 38, after which nut 42 is tightened thereon and a screw member is inserted into sleeve 24 in a manner to engage threads 36 thereof with threads 26 of the sleeve. The screw member is tightened until cap 28 is flush with sole plate 14, at which time O-ring 34 is in sealing engagement with the proximate end of sleeve 24 to prevent moisture and other foreign materials from entering bore 20.

In order to change the weight of insert 22, it is only necessary to unscrew head 28 of the screw member by means of a screw driver or the like and then remove it from tubular sleeve 24. Nut 42 and lock washer 44 are then removed and discs 40 are added or subtracted to effect the desired weight. Nut 42 and lock washer 44 are next replaced and the screw member is reinserted in tubular sleeve 24 and tightened.

When the weight insert is positioned, it is located close to the striking face of the golf club proximate the "sweet spot" of the face's epoxy insert and is aligned with the club shaft and grain of the block from which the club head is made. As a result, when the golf club is swung, the location of the insert creates a zero moment of force with the swing plane axis at impact and the center of gravity of the club is centered on the swing weight in the hitting area of the striking face. Consequently there is effected better swing control and club balance than has heretofore been possible with weight inserts heretofore employed, with resultant increased accuracy and distance when the golf ball is hit.

The insert of the present invention is preferably made of aluminum when applied to steel shafted clubs and brass when applied to graphite shafted clubs in order to adjust for the difference in weight between steel and graphite clubs.

The weight insert of the present invention therefore provides simple but effective means applicable to a standard golf club for varying the weight of a golf club and which, by virtue of the strategic positioning thereof, enables the club to be weighted without adversely affecting the control and balance of the club, regardless of the amount of weight which is added to the golf club.

While there has been herein shown and described the presently preferred form of this invention, it is to be understood that such has been done for purposes of illustration only, and that various changes may be made within the scope of the appended claims.

What is claimed is:

1. A golf club having a recess in the head thereof for receiving a weight insert, the weight insert including:

a. a tubular sleeve having a flat annular bottom surface at one end thereof positioned in the head recess, b. said one end thereof being internally threaded, c. a flat headed screw member, d. the head of said flat head screw having a diameter equal to the outside diameter of said sleeve, e. a first threaded shank on said screw member threadedly engageable with the internally threaded end of said sleeve, f. said flat headed screw member further including a non-threaded shoulder forming a substantial annular recess between said flat head and said first threaded shank, g. an O-ring seated in said annular recess, the thickness of which O-ring approximates the height of said annular recess, h. the diameter of said O-ring approximating the diameter of said flat head, i. a second threaded shank having a cross section less than the cross section of said first shank and extending centrally and axially from said first shank, j. weight means positioned on said second threaded shank and of a diameter less than said sleeve and positioned within said sleeve, k. retaining means threadedly engaged in said second threaded shank for holding said weight means thereon, l. said retaining means having a diameter less than said sleeve, m. said retaining means, said weight means and said second threaded shank being positioned in assembled relation within said sleeve, and n. said O-ring, when said first threaded shank is threaded in said sleeve, being compressed between said flat annular bottom of said tubular sleeve, said flat head, said annular recess and said recess in the golf club head.

2. A weight insert for a golf club including:

a. a tubular sleeve having a flat annular bottom surface at one end thereof, b. said one end thereof being internally threaded, c. a flat headed screw member, d. the head of said flat headed screw having a diameter equal to the outside diameter of said sleeve, e. a first threaded shank on said screw member threadedly engageable with the internally threaded end of said sleeve, f. said flat headed screw member further including a non-threaded shoulder forming a substantial annular recess between said flat head and said first threaded shank, g. an O-ring seated in said annular recess, the thickness of which O-ring approximates the height of said annular recess, h. the diameter of said O-ring approximating the diameter of said flat head, i. a second threaded shank having a cross section less than the cross section of said first shank and extending centrally and axially from said first shank, j. weight means positioned on said second threaded shank and of a diameter less than said sleeve and positioned within said sleeve, and k. retaining means threadedly engaged in said second threaded shank for holding said weight means thereon, l. said retaining means having a diameter less than said sleeve, m. said retaining means, said weight means and said second threaded shank being positioned in assembled relation within said sleeve, and n. said O-ring, when said first threaded shank is threaded in said sleeve, being compressed between said first annular bottom of said tubular sleeve, said flat head and said annular recess and extending outwardly beyond the external diameter of said sleeve.

* * * * *